US007145292B2

(12) United States Patent
Hitzschke et al.

(10) Patent No.: US 7,145,292 B2
(45) Date of Patent: Dec. 5, 2006

(54) DISCHARGE LAMP FOR DIELECTRIC BARRIER DISCHARGES, WITH OVERHANGING DISCHARGE ELECTRODE SECTIONS

(75) Inventors: Lothar Hitzschke, München (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 327 days.

(21) Appl. No.: 10/787,586

(22) Filed: Feb. 27, 2004

(65) Prior Publication Data

US 2004/0174113 A1 Sep. 9, 2004

(30) Foreign Application Priority Data

Mar. 7, 2003 (DE) ..... 103 10 144

(51) Int. Cl.
*H01J 1/62* (2006.01)
*H01J 17/04* (2006.01)

(52) U.S. Cl. ..... 313/631; 313/620; 313/622; 313/491; 313/484; 315/169.4

(58) Field of Classification Search ..... None
See application file for complete search history.

(56) References Cited

U.S. PATENT DOCUMENTS

| | | | | |
|---|---|---|---|---|
| 6,060,828 | A * | 5/2000 | Vollkommer et al. | 313/607 |
| 6,376,989 | B1 * | 4/2002 | Vollkommer et al. | 315/274 |
| 6,411,039 | B1 | 6/2002 | Vollkommer et al. | |
| 6,636,004 | B1 | 10/2003 | Vollkommer et al. | |
| 6,657,392 | B1 * | 12/2003 | Hitzschke et al. | 315/58 |
| 2002/0154258 | A1 | 10/2002 | Fujishiro et al. | 349/70 |
| 2004/0150317 | A1 * | 8/2004 | Kim et al. | 313/491 |

* cited by examiner

*Primary Examiner*—Sikha Roy
(74) *Attorney, Agent, or Firm*—Robert F. Clark

(57) ABSTRACT

The present invention relates to novel discharge structures for dielectric barrier discharge lamps, in which discharge electrode sections, which are associated with the individual discharges, of the respective electrode strips overhang adjacent sections of the electrode strips.

16 Claims, 3 Drawing Sheets

DISCHARGE LAMP FOR DIELECTRIC BARRIER DISCHARGES, WITH OVERHANGING DISCHARGE ELECTRODE SECTIONS

TECHNICAL FIELD

The present invention relates to discharge lamps which are designed for dielectric barrier discharges.

BACKGROUND ART

Discharge lamps such as these have been described per se in the prior art, and widely differing details relating to them have already been described in previous patent applications from the same applicant. The fundamental physical and technical details of such discharge lamps will not be described any further in detail here but, instead of this, reference should be made to the relevant prior art, in which these lamps are also occasionally referred to as silent discharge lamps. They are also particularly suitable for pulsed operation which results in the light being produced with particularly high efficiency.

In particular, the prior art patent U.S. Pat. No. 6,411,039 B1 disclosed meandering electrode shapes, by means of which the discharge distance between the most closely adjacent electrodes which are in the form of strips is in each case modulated in a discharge lamp such as this. By way of example, sinusoidal shapes or sawtooth shapes are described in this case.

DISCLOSURE OF THE INVENTION

The present invention is based on the technical problem of specifying a discharge lamp for dielectric barrier discharges, which has a new and advantageous electrode shape.

For this purpose, the invention is based on a discharge lamp having a discharge vessel which bounds a discharge volume and has two or more electrodes which are in the form of strips and are at least partially separated by a dielectric layer from the discharge volume, and are designed to produce a dielectric barrier discharge, with at least some of the electrodes which are in the form of strips having discharge electrode sections which are most closely adjacent to respectively adjacent electrodes and are designed such that individual discharges burn on them, characterized in that the discharge electrode sections overhang adjacent sections of the respective same electrode strip, in such a way that they spring back from the respectively most closely adjacent of the other electrode strips.

The invention is also based on a lighting system comprising a discharge lamp such as this and an associated electronic ballast, and on an operating method for operating the discharge lamp and the lighting system.

Preferred refinements of the invention are described in the dependent claims and in the following description. The disclosure in the description in this case relates not only to the apparatus character of the invention but also to the method character of the invention, and the respective details of its features should be understood in both contexts.

In the discharge lamp according to the invention, those sections of an electrode strip which are most closely adjacent to the respective adjacent electrode strip are referred to as a discharge electrode section. The discharge electrode sections are thus the sections of an electrode strip on which individual discharges burn during operation. In this case, discharge electrode sections which are associated with different adjacent electrode strips may also occur along one electrode strip. In the cited prior application, the discharge electrode sections thus correspond, for example, to the maxima and minima or to the peaks of sinusoidal or sawtooth wave shape.

In this invention, the aim is to design the discharge electrode sections such that they overhang adjacent sections of the same electrode strip, that is to say the electrode strip sections which are adjacent to the respective discharge electrode section. In this case, the discharge electrode sections at the overhanging point are intended to spring back from the adjacent one of the other electrode strips, that is to say to move away from it. In other words: the electrode strips are intended to be undercut at the edge of the discharge electrode section in a perspective coming from the respective discharge electrode section.

If, as an example, analogous to the description of the conventional electrode shape from the cited prior application as sinusoidal waves, an electrode strip according to the invention is considered plotted in a coordinate system, with the abscissa corresponding to the main strip direction, then at least two ordinate values should be associated with one abscissa value in an edge area of the discharge electrode sections, and not in each case only one ordinate value as in the vicinity of the maximum and minimum areas of the sinusoidal wave. Reference is made to the exemplary embodiments in order to illustrate this.

With the configuration of the discharge electrode sections as those electrode sections which are most closely adjacent to the respectively adjacent electrode strips, this means that this invention also results in a modulated discharge separation. However, the overhanging shape according to these explanatory notes has the consequence that this results in lengthened electrode strip paths for the current flow between the discharge electrode section and other discharge electrode sections of the same electrode strip. It has been found that this has advantageous characteristics on the formation of the individual discharges. In particular, charge carrier exchange processes obviously take place to a lesser extent. On the one hand, this allows a broader range for selection of the lamp power while, on the other hand, if desired, it allows the individual discharges to be arranged more densely.

Small capacitances between the electrodes can be achieved in this way, by means of appropriate distances between the discharge electrode sections and the other electrode paths. This has advantages for ballast design.

The given explanation preferably applies to all electrode strips in the discharge lamp. However, in principle, this is not absolutely essential and, by way of example, it would be possible to in each case associate electrode strips designed according to the invention with simple straight electrode strips as neighbors. In the case of a discharge lamp in which the electrical connections between the cathodes and anodes can be distinguished by a different configuration or else only by a corresponding polarity association, that is to say the discharge lamp is designed for unipolar operation, it is preferable for at least the anodes to be designed according to the invention.

It is furthermore preferable for the described discharge electrode sections each to overhang in the described manner in both edge areas, that is to say so to speak on the left and on the right. However, it is also within the scope of the invention for the overhanging structure to be provided on only one side.

In particular, according to one refinement, a T-shape or some very similar shape with, for example, a convex roof to the T may be provided, with the expression convex relating to the perspective of the adjacent electrode strip associated with the discharge electrode section.

In any case, irrespective of the T-shape, it is preferable for the discharge electrode section itself to be convex or straight, that is to say not concave, from the perspective of the adjacent electrode strip.

According to one preferred refinement, the electrode strips have branches, with there being at least one branching point to each discharge electrode section. In this context, a branching point is a point on the electrode strip from which the electrode strip continues in more than two directions. The connection between the upright and the upper horizontal bar of the T is one example, and the connecting point of the base of the T to an electrode line section which runs in the main strip direction and is connected to it essentially at right angles to this base is another. Branching structures allow the discharge electrode sections to be connected to a line section of the electrode strip via one or else more than one connecting section, with the described overhanging structure being produced on at least one side, alongside the connecting section. The main line sections between the connecting sections and the discharge electrode sections are preferably essentially straight, as is shown in the exemplary embodiments.

The discharge lamp preferably has a large number of electrodes, which are arranged alternately in individual strips, that is to say with alternate polarity. In a unipolar case, this means that an anode always follows a cathode, and vice versa. In a bipolar case, this applies to the respective unipolar half-periods.

Furthermore, the individual electrode strips are preferably designed such that the individual discharges alternate on both sides along a main strip direction, and this then also applies to the discharge electrode sections when the respective electrode strips for the individual discharges on both sides provide discharge electrode sections in the sense of the invention.

One preferred application of the invention relates to the field of flat radiating elements, as are already known in the context of dielectric barrier discharges. Flat radiating elements such as these may be used in particular for backlighting of displays and similar large-area displays. They have a large number of electrode strips distributed over the area of the flat radiating element.

In addition to the discharge lamp, a lighting system according to the invention also has an associated electronic ballast, which is designed for pulsed operation of the discharge lamp. This ballast is preferably equipped such that it allows the discharge lamp to be dimmed, and the electrode structure according to the invention is particularly suitable for this purpose.

BEST MODE FOR CARRYING OUT THE INVENTION

The invention will be explained in more detail in the following text with reference to a number of exemplary embodiments, which are illustrated in the figures. Individual features which are disclosed in the process may also be significant to the invention in other combinations.

Figure 1:
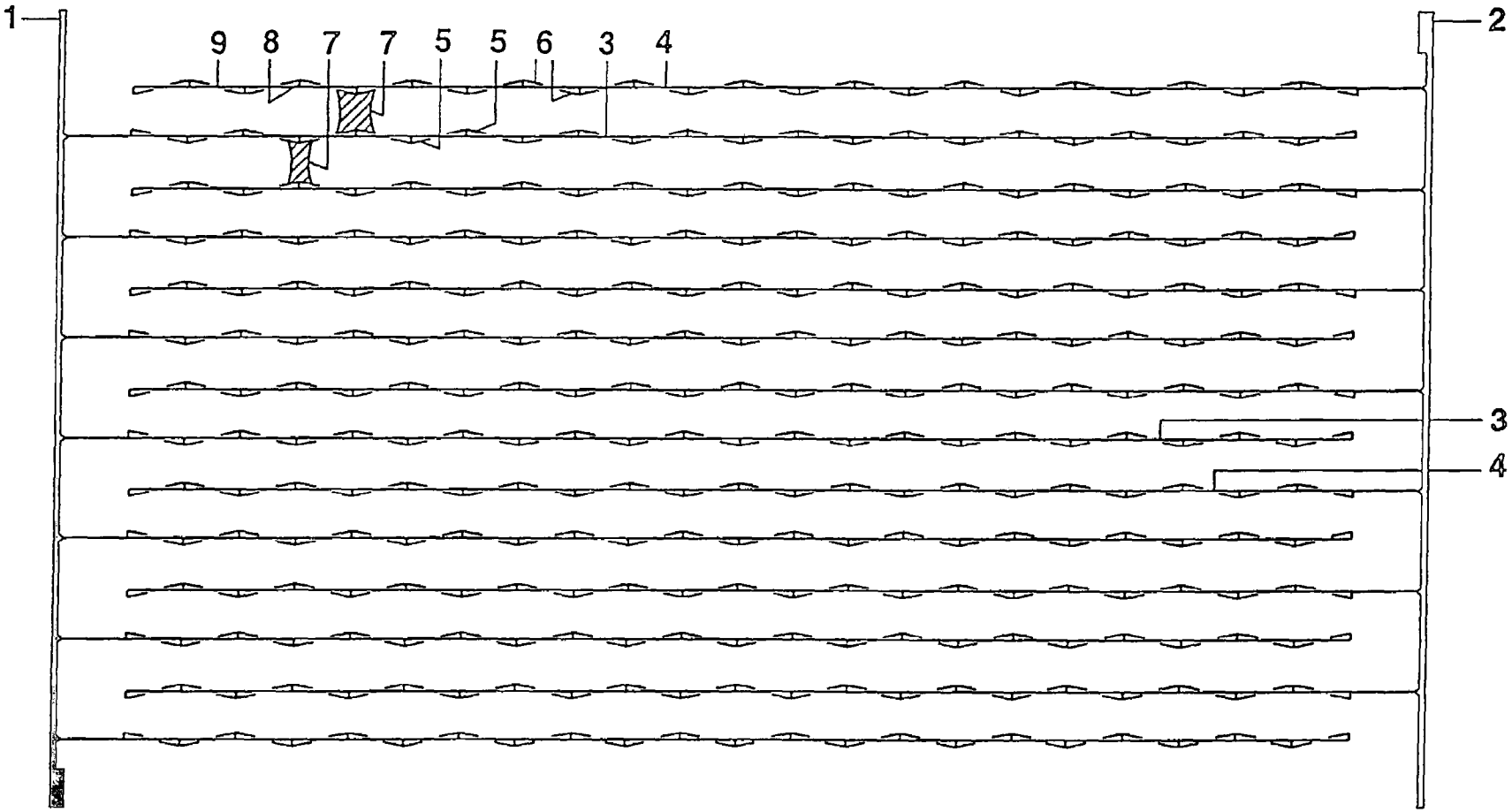
FIG. 1 shows a schematic plan view of an electrode structure according to the invention for a discharge lamp.

FIG. 1 shows a plan view of a part of an electrode structure of a discharge lamp according to the invention. The numbers 1 and 2, on the right and left of FIG. 1, denote common connecting areas for respective electrodes strips 3 and 4. The electrode strips 3 and 4 start at their respective connections 1 and 2 and, together with the connections, form a structure like a comb. In this case, the electrode strips 3 and 4 are arranged alternately, so that this results, so to speak, in an interleaved structure of two comb structures whose tines are interleaved in one another. The aim is for dielectric barrier discharges to burn between respectively adjacent electrode strips 3 and 4 during operation of the discharge lamp. In the present case, the connections 1 and 2 as well as the electrode strips 3 and 4 are identical in mirror-image form, and are all covered by a dielectric layer. Thus, in this exemplary embodiment, there is no difference between anodes and cathodes, so that bipolar operation is also possible. The electrode strips 3 and 4 thus act alternately as cathodes and anodes.

As can also be seen, the electrode strips 3 and 4 have respective discharge electrode sections 5 and 6 which are arranged alternately on both sides (that is to say on the top and bottom in FIG. 1), in each case along the main strip direction, which runs horizontally in FIG. 1. The main strip direction is, in the end, approximately a mean value over the entire length of an electrode strip. The discharge electrode sections 5 are part of the electrode strips 3 and point upwards and downwards alternately. The corresponding situation applies to the discharge electrode sections 6 and to the electrode strips 4.

In this case, discharge electrode sections 5 and 6 are in each case located opposite one another very closely adjacent to one another, between adjacent electrode strips 3 and 4. The shortest distances between the electrode strips 3 and 4 occur between these most closely adjacent discharge electrode sections 5 and 6. The discharge electrode sections 5 and 6 thus modulate the discharge distance between the electrode strips 3 and 4 and thus characterize the area in each case between the most closely adjacent discharge electrode sections 5 and 6 as the preferred location for individual discharges. By way of example, two individual discharges 7 are shown between the uppermost three electrode strips 3 and 4 in FIG. 1 and, during operation of the lamp, these would burn in a form such as this or in a similar form between all of the most closely adjacent discharge electrode sections 5 and 6. As a result of the bipolarity two triangular individual discharges, which are typical of the respective polarities, are in this case superimposed to form a shape which is overall somewhat cushion-shaped. The two individual discharge structures 7 are illustrated in FIG. 1 in such a way as to show that they correspond to different power levels and accordingly occupy different widths of the discharge electrode sections 5 and 6.

Each individual discharge electrode section 5 or 6 has a T-like shape with a roof which is relatively broad in comparison to the upright "trunk" 8 of the T, and which in contrast to the letter "T" is bent downwards somewhat on both sides. From the perspective of the most closely adjacent discharge electrode section, the discharge electrode sections are thus somewhat convex with corners, with a point which is located at the junction point between the "trunk" 8 of the T and the "roof" of the T.

Depending on the power of the discharge lamp, the individual discharges 7 burn between a central area of the discharge electrode sections 5 and 6 in the vicinity of the tip, or over the entire width of the respective "roof", as is shown in FIG. 1. The individual discharges 7 are in this case therefore coupled via the electrode strips via the roof-like sections of the discharge electrode sections 5 and 6, the respective "trunk", that is to say the connecting section 8 to the main line sections 9 which are straight and horizontal in FIG. 1, and the respective piece of the main line section 9 as far as the next discharge electrode section 5, 6 and there once again via the connecting section 8 of the T and the "roof" of the T-shape.

The electrode structure described here thus has discharge electrode sections 5, 6 whose respective halves of the "T roof" overhang the connecting sections 8. In this case, the wording "springing back", that is chosen in the claims is intended to mean that the other electrode strips 3, 4 adjacent to the respective discharge electrode section 5 or 6, that is to say the respective line section 9, is further away from the most closely adjacent of the other electrode strips. The illustrated geometry is therefore intended to differ from the situation in which the overhang is produced, for example, in a third dimension at right angles to the plane of the drawing in FIG. 1.

As can also be seen from FIG. 1, the respective T-shaped discharge electrode sections 5 and 6 form an undercut on both sides between the "T roof" and the line sections 9, that is to say on the right and left in FIG. 1.

In contrast to the conventional sinusoidal shape that has been mentioned, the discharge electrode sections 5, 6 are in this case not connected to the line sections 9 at their respective right-hand and left-hand ends, but are connected centrally via the connecting section 8, on which there are branching points both at the junction to the "T roof" and at the junction to the line sections 9. Each of the electrode strips continues in three directions from these branching points.

Overall, in this case, FIG. 1 shows the electrode structure of a flat radiating element for back-lighting of a monitor. The actual flat radiating element may have an electrode structure which corresponds to that shown schematically in FIG. 1, but is far larger. In addition, a dimmable electronic ballast may be provided. The electrode structures illustrated here are particularly suitable for a dimming function.

Figure 2:
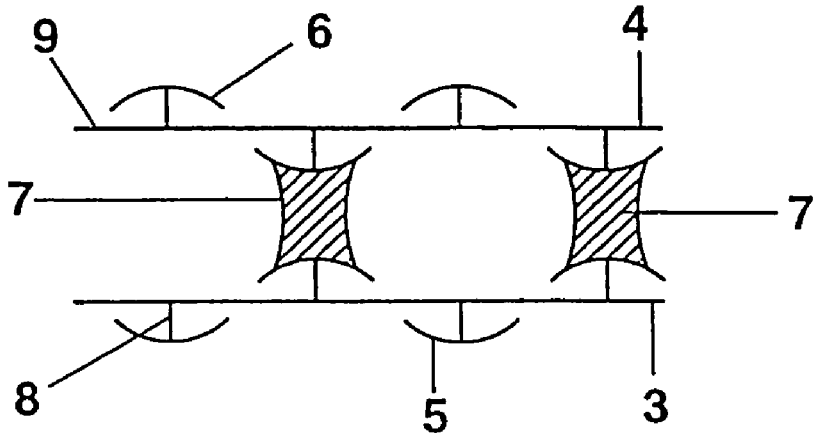
FIG. 2 shows a detail of a further electrode structure as a second exemplary embodiment.

FIG. 2 shows an alternative to FIG. 1, but with only a small detail being shown, for the sake of simplicity. The same reference numbers are used in order to denote corresponding elements. The difference from FIG. 1 is only that the "roofs" of the T-shaped discharge electrode sections 5 and 6 have a rounded convex shape here, to be precise forming details of an imaginary sine wave in each case. The electrode structure described here thus corresponds in terms of the discharge electrode sections 5, 6 to the conventional sinusoidal electrode strips, but is sinusoidal only in places. (In a corresponding manner, a structure as shown in FIG. 1 could also be provided with a sawtooth shape in places.)

Figure 3:
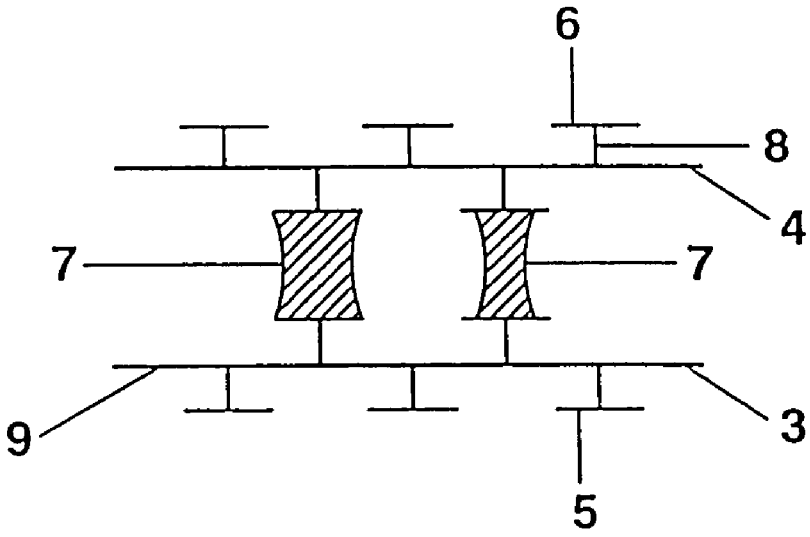
FIG. 3 shows a further detail as a third exemplary embodiment.

FIG. 3 shows a further alternative in which the "roofs" of the T-shaped discharge electrode sections 5 and 6 are straight and are in this case parallel to the main strip direction of the respective electrode strips 3 and 4. Thus, in places, this structure corresponds to a square-wave function. In this case, and corresponding to FIG. 1, individual discharges 7 are shown for illustration purposes, which have different widths and therefore correspond to different power levels. It is self-evident that the individual discharges 7 of different sizes shown in FIGS. 1 and 3 do not occur at the same time in the structures illustrated here, but only alternatively, but then between all of the discharge electrode sections 5 and 6.

Figure 4:
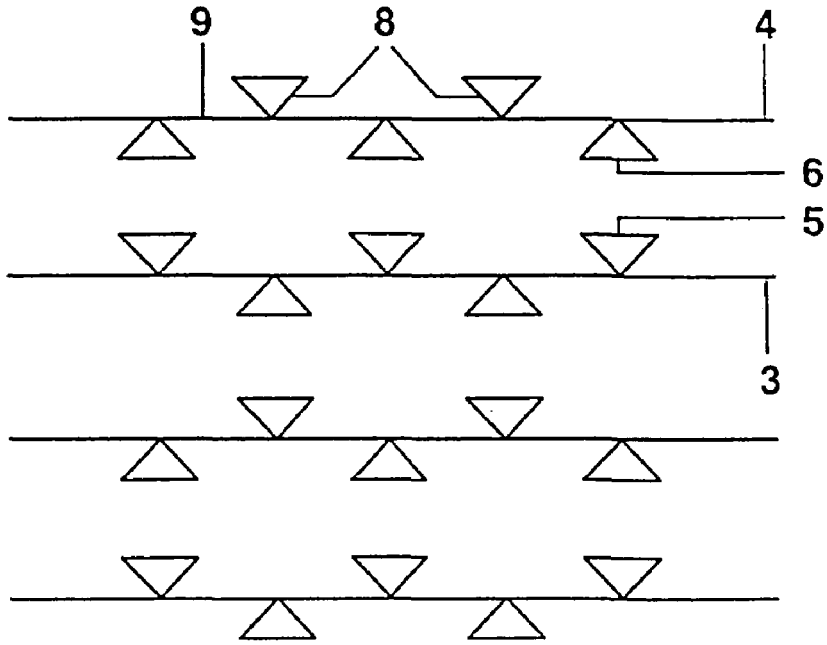
FIG. 4 shows a further detail as a fourth exemplary embodiment.

FIG. 4 shows a further alternative, but in this case with only one branching point for each discharge electrode section 5 or 6. In contrast to the structures as shown in FIGS. 1–3, there are, specifically, two connecting sections 8 in each case in the structure shown in FIG. 4 which, together with the respective "roof", form a triangle, one side edge of which faces the most closely adjacent discharge electrode section. As can be seen, these discharge structures also overhang in a manner such that they spring back in the sense of the present explanatory notes, and form an undercut.

Figure 5:
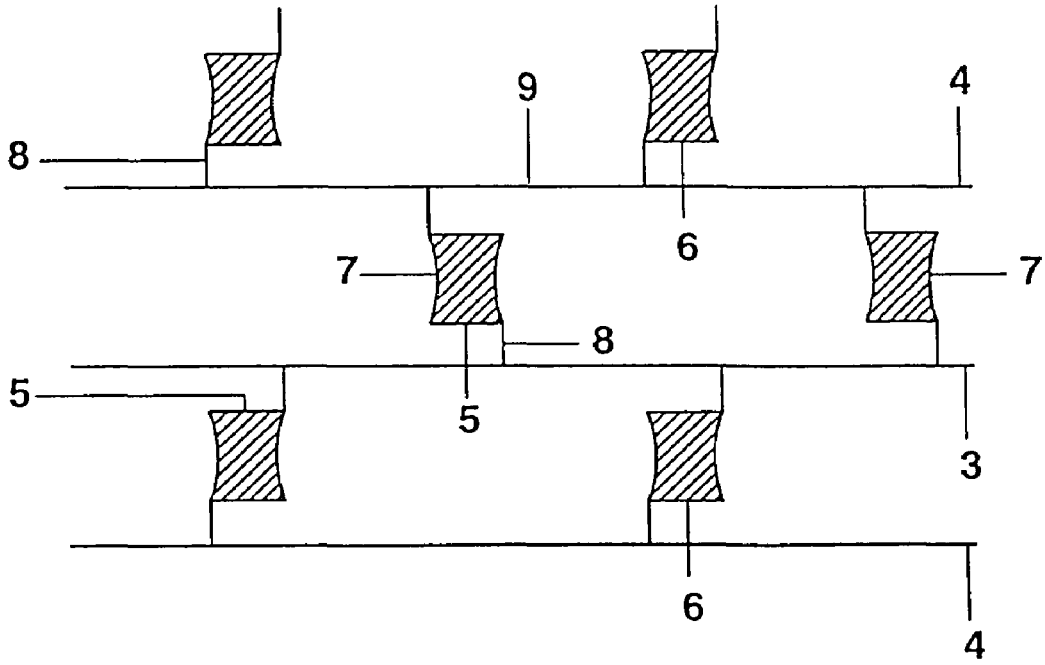
FIG. 5 shows yet another detail as a fifth exemplary embodiment.

FIG. 5 shows a final alternative which corresponds largely to FIG. 3, but which in each case has a "roof" on only one side. The connecting sections 8 are offset with respect to one another in a corresponding manner on adjacent discharge electrode sections 5 and 6 such that the "roofs" which are now on one side, are directly opposite one another. This variant illustrates that the above statements relating to the overhang that springs back and to the undercut need be present on only one side.

What is claimed is:

1. A discharge lamp comprising:

a discharge vessel which bounds a discharge volume, the discharge vessel having two sets of interleaved electrode strips that are at least partially separated by a dielectric layer from the discharge volume, each set of electrode strips being connected at an end to a respective common connecting area;

at least some of the electrode strips having discharge electrode sections connected to the electrode strip by a connecting section, the discharge electrode sections overhanging an adjacent section of the electrode strip to which it is connected; and a shortest distance between adjacent electrode strips occurs at the discharge electrode sections such that individual discharges burn on the discharge electrode sections when the lamp is operated.

2. The discharge lamp as claimed in claim 1, in which all the electrode strips have discharge electrode sections that each overhang adjacent sections of the electrode strip to which they are connected.

3. The discharge lamp as claimed in claim 1, in which each end of the discharge electrode section overhangs the adjacent section of the electrode strip to which it is connected.

4. The discharge lamp as claimed in claim 3, in which the discharge electrode sections are convex or straight when viewed from the adjacent electrode strip.

5. The discharge lamp as claimed in claim 1, in which the discharge electrode section together with its connecting section are essentially T-shaped.

6. The discharge lamp as claimed in claim 1, in which the discharge electrode sections are convex or straight.

7. The discharge lamp as claimed in claim 1, in which the connecting sections are essentially perpendicular to the electrode strips to which they are connected.

8. The discharge lamp as claimed in claim 7, in which the discharge electrode sections are convex or straight when viewed from the adjacent electrode strip.

9. The discharge lamp of claim 7, in which each discharge electrode section is connected to its respective connecting section at one end of the discharge section.

10. The discharge lamp as claimed in claim 8, in which each end of the discharge electrode section overhangs the adjacent section of the electrode strip to which it is connected.

11. The discharge lamp as claimed in claim 1, in which the electrodes strips are essentially parallel to each other and arranged with alternating polarity.

12. The discharge lamp as claimed in claim 1, in which, during operation, individual discharges burn on alternate sides along a respective main strip direction of at least some of the electrode strips that have discharge electrode sections.

13. The discharge lamp as claimed in claim 1, which is in the form of a flat radiating element with an essentially flat discharge vessel and a large number of electrode strips which are distributed over the surface of the discharge vessel.

14. The discharge lamp of claim 1, in which the connecting section and the discharge electrode section together comprise a triangular shape and a point of the triangular shape connects to the respective electrode strip and the individual discharges burn on a side of the triangular shape opposite the connecting point.

15. The discharge lamp of claim 1, in which each discharge electrode section is connected to its respective connecting section at one end of the discharge section.

16. The discharge lamp of claim 1 wherein a cushion-shaped discharge burns on the discharge electrode sections.

* * * * *